United States Patent [19]

Stanford, Jr.

[11] Patent Number: 4,517,701

[45] Date of Patent: May 21, 1985

[54] TOOTHBRUSHES FOR CLEANING SULCULAR AREAS OF THE TEETH

[76] Inventor: Roy E. Stanford, Jr., 6829 Tennyson Dr., McLean, Va. 22101

[21] Appl. No.: 597,570

[22] Filed: Apr. 9, 1984

Related U.S. Application Data

[63] Continuation of Ser. No. 488,627, Apr. 25, 1983, abandoned, which is a continuation-in-part of Ser. No. 283,031, Jul. 13, 1981, abandoned.

[51] Int. Cl.[3] ..... A46B 9/04

[52] U.S. Cl. ..... 15/106; 15/167 R; 15/143 R

[58] Field of Search ..... 15/106, 110, 167 R, 15/167 A, 143 R

[56] References Cited

U.S. PATENT DOCUMENTS

| | | | |
|---|---|---|---|
| D. 29,219 | 8/1898 | Ufford | 15/167 R |
| D. 90,106 | 6/1933 | Falk | 15/167 R |
| 1,513,104 | 10/1924 | Gracey | 15/167 |
| 2,123,407 | 7/1938 | Dullea | 15/106 X |
| 3,720,975 | 3/1973 | Nelson | 15/167 |
| 3,864,781 | 2/1975 | Leonard | 15/167 |
| 3,939,520 | 2/1976 | Axelsson | 15/167 |

FOREIGN PATENT DOCUMENTS

| | | | |
|---|---|---|---|
| 571181 | 9/1958 | Belgium | 15/167 R |
| 417353 | 1/1947 | Italy | 15/167 R |

*Primary Examiner*—Peter Feldman

*Attorney, Agent, or Firm*—Birch, Stewart, Kolasch & Birch

[57] ABSTRACT

A toothbrush arrangment is provided specifically for cleaning sulcular areas of the teeth below the gum line. The brush head is curved and has bristles extending from opposite sides thereof, facilitating an improved access to the teeth, particularly at the gingival margins. In one embodiment, the bristles are arranged in rows which may be canted inward along the curve, with tufts on opposite sides of the curved brushing head providing access to oppositely curved dental profiles. In a second embodiment, the bristles are arranged in a single row on a miniaturized brush head. The miniaturized arrangement is particularly suited for cleaning of the sulcular areas, both at and below the gum lines in the treatment of periodontal disease and for general oral hygiene.

16 Claims, 16 Drawing Figures

TOOTHBRUSHES FOR CLEANING SULCULAR AREAS OF THE TEETH

CROSS-REFERENCE TO RELATED APPLICATION

This application is a continuation of application Ser. No. 488,627 filed on Apr. 25, 1983, now abandoned, which is a continuation-in-part application of Ser. No. 283,031, filed July 13, 1981, now abandoned.

BACKGROUND OF THE INVENTION

1. Field of the Invention

This invention relates to toothbrushing, particularly in the prevention and treatment of periodontal disease. More specifically, this invention is directed to improving access to the gingival sulcus.

Much as through nature, hard structures in an aquatic environment become colonized by numerous living forms specifically adapted for growth upon submerged surfaces gingival sulcus. The teeth provide a natural habitat, or ecological niche, for microbiological life that is uniquely adapted for growth upon hard surfaces in the fluid environment of the mouth and gingival crevices. Certain types of microorganisms can attached themselves to the teeth, proliferate and invade the crevice between the gum margins and teeth, and over a period of years progressively coat the root surfaces. There is evidence that the bacteria that populate the teeth of persons with excellent periodontal health differ markedly from those that inhabit the surfaces adjacent to diseased tissues. Associated with disease are populations that differ with respect to the types of cells, their organization, and also their behavior. For example, disease is associated with flexing masses of spirochetes, gliding rods, amoebae, etc. The toxins produced and circulated by these microorganisms are not tolerated by the periodontal tissues, and as a result, they become inflamed recede, and gradually separate away from the infected root surfaces. Therefore, the primary goal of periodontal thereapy must be the elimination of bacterial populations that release toxic by-products in gingival crevices and pockets, in other words, control of creviculoradicular infection.

Treatment has traditionally been primarily centered in the dental office. In one advanced method of treatment, at each visit of the patient to his dentist, a specimen is removed from selected root surfaces and examined for the prevalance of white blood cells and motile bacteria. All probable spaces are then irrigated or treated with an antiseptic solution, e.g., a 1% solution of chloramine-T. Then the root surfaces are carefully debrided with scalers, files, and other instruments to remove living and mineralized bacterial deposits. The scaling instruments are repeatedly passed through an antiseptic during the debridement procedures.

In addition to professional treatment in a dentist's office, it is beneficial for the patient to administer self-treatment on a daily basis. Such self-treatment usually comprises in addition to toothbrushing, dental flossing, brushing interproximally and irrigation with various antiseptic or antibacterial solutions.

If there has been advanced loss of periodontal attachment (deep pocketing and bone resorption), it may be difficult to obtain adequate suppression of bacteria and white blood cells by office treatments and currently available homecare procedures alone. Therefore, patients may be advised to take an antibiotic, usually tetracycline HCl for two, possibly three weeks to suppress the bacteria in difficult-to-reach areas. Patients take 250 mg of tetracycline four times a day (q.i.d.) one hour before meals and at bedtime with water. If the microscopic examination reveals negative fields at the end of two weeks of therapy, the medication is discontinued. If the microscopic examination does not reveal negative fields, or if the case is very advanced, the antibiotic may be continued for another week, unless there is an acute problem, e.g., parietal abscess, the antibiotic is not prescribed before the roots have been scaled as described, and the patient has learned a home-care regimen appropriate for his needs. The antibiotic is not used again unless microscopic findings indicate that a pyogenic or potentially pyongenic population has reestablished itself.

During the initial stages of treatment patients are seen three to four times over an interval of six to eight weeks. During the follow-up maintenance period patients with advanced problems are examined clinically and microscopically every two or three months to minimize their risk of developing renewed bacterial activity on roots and in circumradicular succi. At each visit all patients receive antiseptic irrigations and scalings that are appropriate for the problem at hand.

The oral hygiene programs used by patients are not inflexible, as a number of variations can effectively reduce the germ life that forms on the surfaces of the teeth. For example, the careful application of various salts (sodium chloride, sodium bicarbonate, sodium recinoleate, sodium periodate, aluminum chlorate, magnesium sulface, zinc phenolsulfonate, etc.) can help to control bacterial activity on root surfaces and in circumradicular succi.

Patients are advised to irrigate, to brush and floss, or to use toothpicks whenever possible soon after eating, because food residues, particularly carbohydrates, contribute to the propagation of bacteria especially adapted for adhesion and growth upon tooth surfaces. Before retiring, or after the last meal or snack of the day, patients are advised to use measures along the following lines:

1. To floss if appropriate with floss or dental tape. This will help to cpen and clear some of the interdental spaces and surfaces. It will not clear concave surfaces, however.

2. To irrigate with water after flossing. Patients with advanced lesions may omit flossing and start with the irrigation. For severe lesions a warm brine solution is usually recommended during the early stages of treatment. Patients using electric irrigators such as the Water Pick (TM) should use lower pressures unless advised differently. Placement of the irrigator tips, some of wbich are custom-made, is demonstrated on special models, at chairside, and if necessary before a mirror over a sink.

3. After the irrigation the teeth may be treated with mixture of 3% hydrogen peroxide, salt (sodium chloride), and baking soda (sodium bicarbonate). One way to prepare the mixture follows: a bottle-capful of peroxide is poured into a tumbler or medicine cup; about $\frac{1}{4}$ teaspoon of salt is added to the solution. The bristles of the toothbrush are moistened with the peroxide-saline solution and then dipped into baking soda. Some of the soda will cling to the bristles (as conventional toothbrushing with baking soda) and the bristles are then used to smear the mixture along the gum margins and into the spaces between the teeth. Typically, the teeth are not brushed at this time. Instead, the patient is urged to use the tip of a finely pointed stimulator (e.g. Butler 600) to wipe bacteria and pus from his root surfaces by inserting the point gently between the his gum margins and teeth and by moving it carefully along the tongue-side and cheek-side of the teeth. The procedure includes pressing the tip firmly into spaces between the teeth to squeeze out bacteria and pus from approximal root surfaces. A mirror with a good light source is usually necessary to enable one to watch this procedure carefully. After every tooth has been carefully encircled in this manner, the teeth are brushed with the soda-salt-peroxide mixture.

The patient then brushes, using a small brush with fine flexible bristles. The brush is held at about a 45° angle towards the gingival margins and it is rapidly jiggled back and forth to distribute the antibacterial paste into the crevices between the teeth and gum margins (gingival crevices). For this purpose an electromechanical toothbrush can be very helpful. One that has a fast circular motion will help to spin the soda paste into gingival crevices and other difficult-to-reach sites. The electric toothbrush made by Water Pik works well for this purpose because of its circular motion. A toothpick held in a special handle, "Perio-Aid", may be used in areas where more positive action is needed. Various types of special brushes may be recommended for special situations. Patients need guidance from a dentist or a hygienist for proper use of these procedures.

After using the salt preparation, patients should rinse with water until all taste cf salt has disappeared. Patients on low-sodium diets can substitute magnesium sulfate (Epsom salt, $MgSO_4$) for the sodium chloride and sodium bicarbonate. The taste is slightly bitter when first applied, but not objectionable. With magnesium sulfate the consistency of the paste will be somewhat granular. Glycerol, GlyOxide and other adjuvants may be tried. The efficacy of tbe agents and delivery system will be revealed by periodic microscopic examinations of specimens removed from the circumradicular spaces.

4. If root surfaces become sensitive after the gums receed, patients are advised to apply a few drops of fluoride gel (1.0% neutral or slightly acidulated sodium fluoride gel available on prescription) to the sensitive areas with a cotton swab, the stimulator, or a brush. The fluoride treatment is applied after the teeth have beer cleaned as described, and the mouth is not rinsed after the application. Sensitivity usually subsides within a few days. The gel can be reapplied if needed.

As can be seen, such a procedure is usually quite time-consuming, in the order of 35 minutes for each daily routine. This requires, in addition to a certain amount of personal will from the patient, at least an average intellectual capacity in order that he can comprehend all of the steps required. It would therefore be desirable to Irovide an arrangement which can be used to combine all of the above steps (with the exception of step 5) into one or two steps.

DESCRIPTION OF THE PRIOR ART

Various arrangements have been proposed to modify toothbrushes to facilitate cleaning of the gingival and interproximal areas of the teeth. For example, a device called Proxabrush (TM), marketed by the John O. Butler Company is sized, and positioned by a special handle, to fit into the interproximal spaces between teeth. This device is represented by U.S. Pat. No. 4,222,143. While cleaning of the interproximal areas of the teeth is desirable, my invention is directed to a thorough cleaning of the sulcular areas between the gums and the teeth. Various other arrangements to clean the interproximal areas have been advanced.

Various arrangements have been advanced which provide brushes which are particularly suitable for cleaning certain areas of the teeth and gums. One toothbrush arrangement surrounds a group of center bristles with bristles which are softer and longer in order to provide an improved massage of the gums and improve the cleaning of the teeth. A few toothbrushes have been advanced having curved toothbrush heads or toothbrush heads with oppositely-disposed bristles. For example, a toothbrush proposed by Gracey in U.S. Pat. No. 1,513,104 provides a wrap-around arrangement for bristles resulting in the majority of the bristles extending from opposite sides of an oval head. By providing an upwardly-curved portion of the stem, the insides of the teeth can be brushed. with the handle held flat and the upwardly-turned portion remaining clear of the front teeth.

A curved head toothbrush is described in Funk, U.S. Pat. No. 2,697,239. In that arrangement, the brushhead is arranged transversely to the stem of the toothbrush, so that the handle extends outwardly from the mouth, perpendicularly to the gum lines of those teeth being brushed.

Despite the various past proposals, no prior art toothbrush is presently known which combines a curved toothbrush head with bristles disposed on opposite sides of the toothbrush in order to provide improved access to the teeth and to the sulcular areas. Additionally, it should be noted that the curvature of a toothbrush head tends to restrict the toothbrush to brushing curves in one direction, permitting the improved access only to certain areas of the mouth. For example, a toothbrush having a stem which curves, with the bristles facing downward, away from the handles to the left would be useful for brushing the tongue side and the cheek side areas of the teeth in the lower left jaw and in the upper right jaw, while presenting only a cumbersome arrangement for brushing the teeth in the lower right jaw and the upper left jaw.

Furthermore, when it is desired to reach into the sulcus between teeth, a curvature of the brushhead is often necessary in order to facilitate the brush fitting between the gum and the roots of the teeth without unduly lacerating the gums.

It is felt that, by providing a group of brushes which are specifically adapted to cleaning the sulcular areas of the teeth, that the daily-treatment routine can be greatly simplified and accomplished in a reduced amount of time. By penetrating the sulcular areas with a brushing device, the teeth are generally cleaned, with normal toothbrushing functions being accomplished with little additional effort.

SUMMARY OF THE INVENTION

It is accordingly an object of the invention to provide and improve means for cleaning the teeth and particularly the sulcular areas of the teeth. It is an additional object to provide a toothbrush which may be controlled to and is contoured to provide an improved access to the sulcular areas of the gums to permit a more thorough cleaning of these areas, particularly in the treatment of periodontal disease. By providing such an arrangement, the routine for daily self-treatment for patients is simplified and made less time consuming, with the routine being comprehensible even to people of mediocre intelligence.

Accordingly, in one aspect of the invention, a toothbrush is provided wherein tufts extend from opposite sides of a curved bristle-supporting portion. The curved portion forms an extension of the handle portion, with the sides being arranged generally within the plane of the curvature, providing an improved access to the sulcular areas between the teeth and gums.

In a further aspect of the invention, at least one row of bristles can be canted inward toward the concave side of the curvature, facilitating, not only better control of the toothbrush, but also improved access to the sulcus. Further control is facilitated by providing a handle with a thumb and finger-receiving portion so as to aid in the control of the toothbrush and to further facilitate access to the sulcus.

In another aspect of the invention, the bristles are molded into a bristle-supporting portion of the brush so that the brush may be inserted in the interproximal areas of the teeth for the insertion into the sulcus below the interproximal gum lines.

DETAILED DESCRIPTION OF THE PREFERRED EMBODIMENTS

Figure 1:
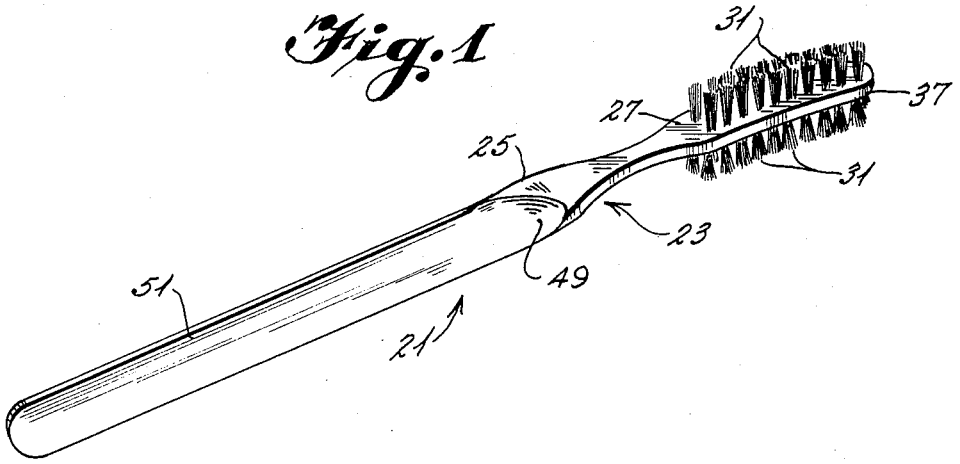
FIG. 1 is a perspective view of the toothbrush according to one embodiment of the invention.
Figure 2:
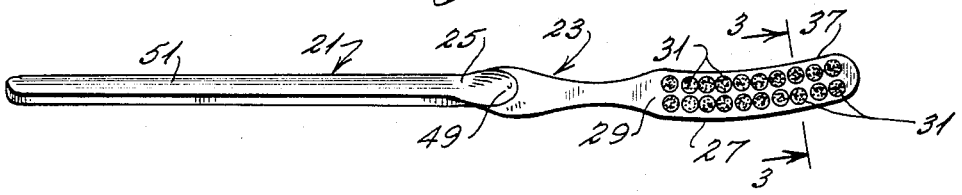
FIG. 2 is a top view of the toothbrush of FIG. 1.
Figure 3:
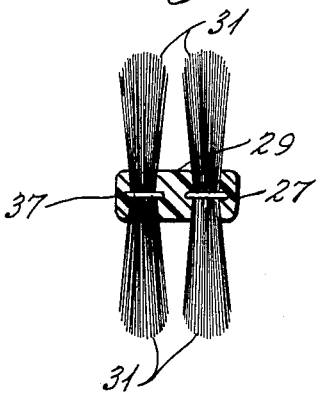
FIG. 3 is a sectional view taken along lines 3—3 of FIG. 2.

Referring to FIG. 1, the toothbrush 21 according to the invention comprises a stem 23 consisting of a handle 25 and a bristle-supporting head 27. As is the case with conventional toothbrushes, the handle 25 and the head 27 are preferably molded as a single piece. Referring to FIGS. 1–3, two oppositely disposed faces 29 which are generally parallel to the plane of head 27 appear on the head 27 from which tufts of bristles 31 extend. The head 27 is generally curvate so that the faces 29 form disc portions.

Referring particularly to FIG. 3, it can be seen that the tufts 31 extend completely from the head 27 so as to occur on opposite sides of the head 27. Thus, while the view of the toothbrush from FIG. 1 shows toothbrush curving (looking from the handle 25) to the right, the same toothbrush can be turned over so as to appear curving to the left as shown in FIG. 2. It can be seen that, by having tufts 31 extending opposite the faces 29 of the toothbrush, a symmetry is achieved. It is clear, as will be described later, that, even though the toothbrush is curved, the single head of the toothbrush is useful for all teeth as will be described later.

Figure 4:
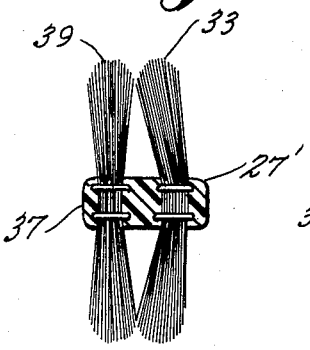
FIG. 4 is a sectional view, as in FIG. 3, showing a modification in the toothbrush of FIGS. 1 and 2, showing an arrangement for canting the bristles.
Figure 5:
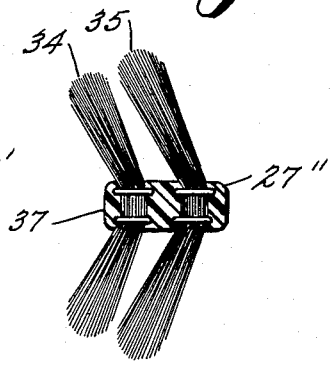
FIG. 5 is a sectional view as in FIGS. 3 and 4, showing yet another modification of the toothbrush of FIGS. 1 and 2 wherein the bristles are canted.

The tufts 31 are preferably made from soft or extra soft rounded tip bristles in order to facilitate thorough cleaning of the sulcular areas without lacerating the soft tissue of the sulcus. As described above, the curved contour of the toothbrush head 27 improves access to the sulcus. Further enhancement of the function may le had by angling one or more rows of tufts as seen in FIGS. 4 and 5. In these figures, tufts 33, 34 and 35 are canted toward the concave side 37 of toothbrush head 27′and 27″. While this cant can be provided at various angles, a cant which is 15° from parallel to the axis of curvature would be typical. Referring to FIG. 4, by providing some tufts such as tuft 39 at the ends of the tufts, a tuft concentration is provided at the point where it is most desired to achieve a brushing action; that is under the sulcus, particularly when a minimum of force is applied by the user.

It may also be advantageous to cant the tufts 31 inward in order to permit brushing without the bristles harshly rubbing the inside of the patient's cheek.

Figure 5A:
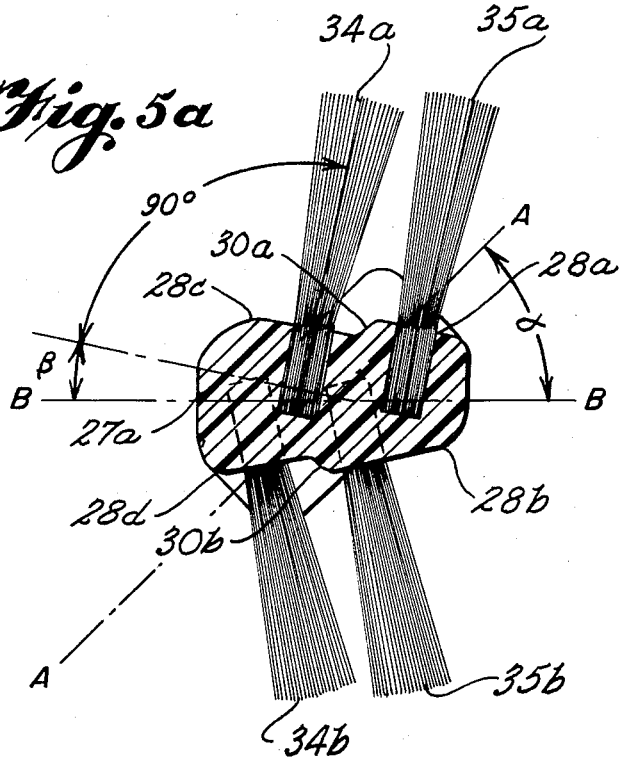
FIG. 5*a* shows the cross-sectional view of the toothbrush head in one embodiment of the present invention.
Figure 5B:
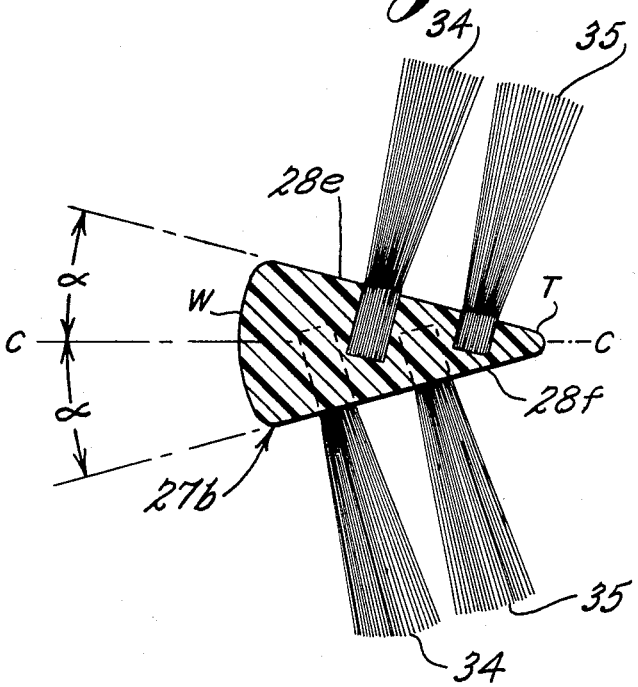
FIG. 5*b* shows the cross-sectional view of the toothbrush head in another embodiment of the present invention.

In the embodiments shown in FIGS. 5*a* and 5*b*, the tufts are canted with reference to the major axis of the toothbrush head and extend perpendicularly from the surface of the head. In FIG. 5*a*, toothbrush head 27*a* is twisted with reference to handle 25 so that angle $\alpha$ between major axis A—A of handle 25 and major axis B—B of toothbrush head 27*a* is about 42° to 48°, preferably 45°. The surfaces 28*a*, 28*c* and 28*b*, 28*d* of the toothbrush head 27*a* from which the tufts extend are slanted at an angle of $\beta$ and are separated by step 30*a* and 30*b*, respectively. $\beta$ ranges from about 10° to 15°. Since surface 28*a*, 28*b*, 28*c* and 28*d* are slanted with reference to axis B—B and since tufts 34*a*, 34*b*, 35*a* and 35*b* extend perpendicularly from the surfaces, the tufts are canted with reference to axis B—B. Typically, tufts 34*a*, 35*a*, 34*b* and 35*b* have the same length.

In the embodiment shown in FIG. 5*b*, toothbrush head 27*b* is twisted with reference to handle 25 at the same angle as shown in FIG. 5*a*. However, the cross-sectional view of the head has the form of a wedge and the surfaces in which the tufts are embedded are not provided with any steps, i.e. the surfaces are continuous. As illustrated in FIG. 5*b*, toothbrush head 27*b* is wedge-shaped, with side W of the head being thicker than the other, T. Tufts 34, 35 extend perpendicularly from surfaces 28*e* and 28*f* of the head. Surfaces 28*e* and 28*f* are inclined with respect to major axis C—C of the toothbrush head at an angle $\gamma$ of from about 10° to 15°. In other words, surfaces 28*e* and 28*f* form an angle of from about 20° to 30° with each other. As a result of the inclined surfaces, tufts 34, 35 are canted with reference to axis C—C although they extend perpendicularly out of surfaces 28*e* and 28*f*. Typically, tufts 34, 35 have the same length. The embodiment shown in FIGS. 5*a* and 5*b* have rounded corners to prevent the user from lacerating his gums.

It should be further pointed out that, while specific tuft arrangements, such as two parallel rows are shown, alternate arrangements are possible. For example, while rounded tip bristles are conventionally provided in Nylon, it is also possible to substitute natural bristles for the rounded-tip bristles. Additionally, a wide variety of bristle heights and cant angles are possible, provided that the ultimate goal of achieving improved access to the sulcular areas of the teeth is facilitated.

Figure 6:
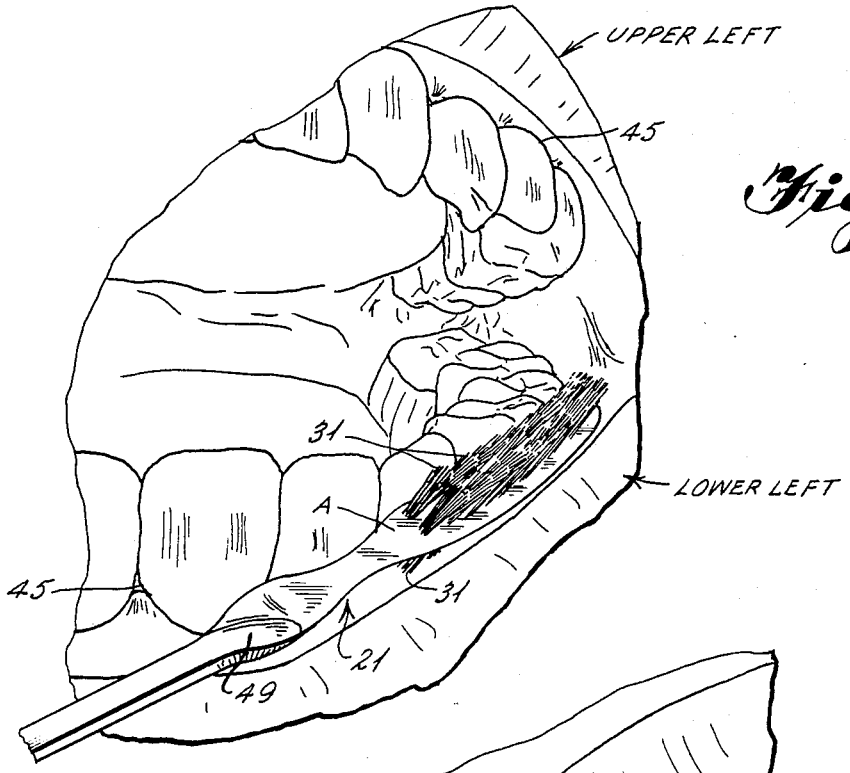
FIGS. 6 and 7 show the toothbrush being used to treat the sulcus of left and right sides of the mouth, respectively.
Figure 7:
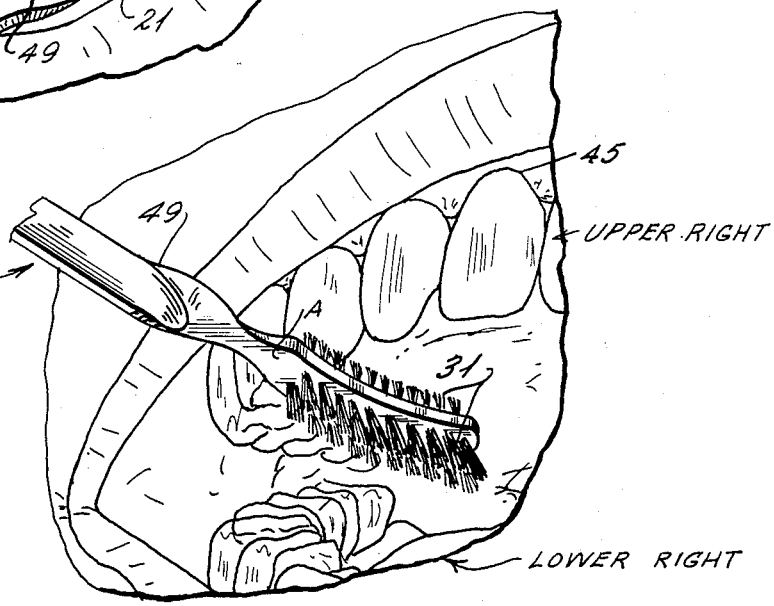
Figure 8:
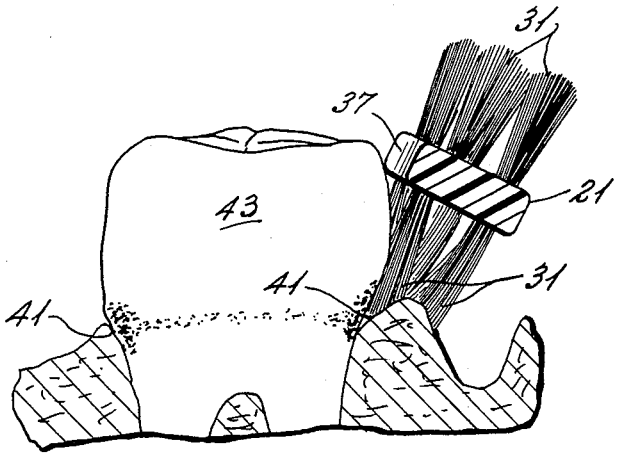
FIG. 8 is a sectional view showing details of the penetration of the brush into the sulcular areas.

Referring to FIGS. 6–8, the toothbrush 21 normally is used in a manner specifically directed to improve access to the sulcular areas. This is accomplished by holding the brush at an acute angle to the surface of the teeth so as to direct the bristles 31 down into the sulcular areas. As can be seen in FIG. 8, since the sulcus 41 is normally diseased when such treatment is prescribed, it tends to be separated from its adjacent tooth 43. There, the toothbrush 21 is so positioned that most of the bristles 31 contacting the teeth are closely adjacent the gingival margins 45 defined by the boundries between the gums and the teeth and consequently the sulcus 41 where the gums contact the teeth. Specifically, it is desirable that at least a portion of the tufts 31 penetrate so as to contact the sulcus 41 and the sulcular areas of the tooth 43.

In order to facilitate the holding of the toothbrush at that position, the handle 25 is preferably contoured as can best be seen in FIGS. 1 and 2. In those figures, the handle 25 has been twisted, leaving depressions 49 on either side of the handle. The user is then able to grip the round part 51 of the handle 25 with his fingers and is able to place his thumb in one of the depressions 49 or at that portion of the stem 23 leaving adjacent the brush head 27 in accordance with his preference. It can be seen that, since the depressions 49 occur on both sides of the toothbrush 21, the toothbrush is reversible. Therefore, in FIG. 6, side A is turned upward whereas in FIGS. 11, side A is turned downward. In both cases, the bristles extending from the face 29 which is opposite side A are contacting the teeth, with tufts 31 on the concave side of the toothbrush 31 contacting the outside of the teeth in FIG. 6 and bristles on the convex side of the toothbrush 31 primarily contacting the teeth in FIG. 7. As is clear from the drawings, the brushing of other teeth would result in the application of other tufts 31 to those teeth. While not shown, it is also possible, particularly when brushing the outside of the teeth, for one to substantially close his jaws and brush both top and bottom rows of the teeth simultaneously. This is, of course, facilitated by having all the bristles canted as shown in FIGS. 5, 5*a* and 5*b*.

Figure 9:
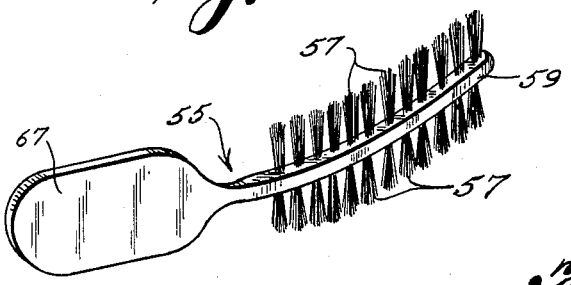
FIG. 9 is a perspective view of another embodiment of the toothbrush according to the present invention.
Figure 10:
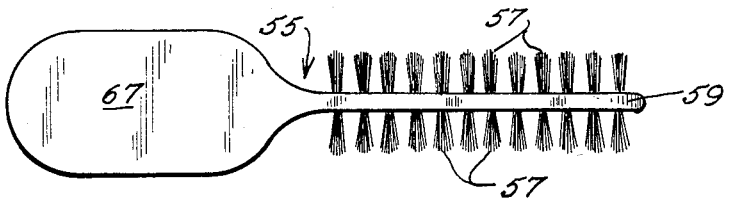
FIG. 10 is a side view of the toothbrush of FIG. 9.
Figure 11:
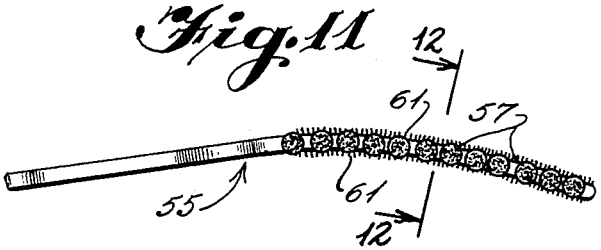
FIG. 11 is a top view of the toothbrush, so as to that shown in FIGS. 9 and 10, further modified to include additional side bristles.
Figure 12:
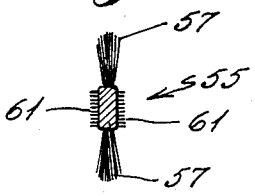
FIG. 12 is a cross-sectional view taken along lines 12—12 of FIG. 11.

In order to provide access to the sulcus in the interproximal areas of the teeth, a smaller version of the curved-head toothbrush is provided as is seen in FIGS. 9–14. Referring to FIG. 9, the small brush 55 is provided with a row of bristle tufts 57 which extends from two sides of a curved brushing head 59 in a manner previously described. These tufts can be single-bristle tufts or the multi-bristle tufts 57 shown. Additionally, the bristles can be molded from the same material together with the remainder of the toothbrush 55, eliminating a necessity to join the bristles in the tufts 57 to the brush head 59 during the molding of the small toothbrush 55. Referring to FIGS. 11 and 12, it is also possible to provide fine brush bristles 61 along the concave and convex side of the brush head 59. This enables the portion of the teeth aligned with the brush head 59 to be cleaned despite a tendency of the teeth and gums to align the brush so that some portions of the teeth would only contact the brushing head 59 rather than tufts 57.

Figure 13:
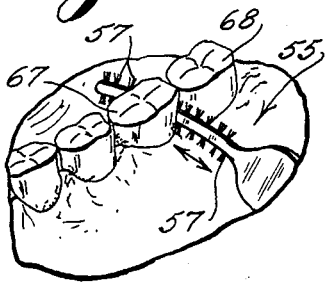
FIG. 13 shows the operation of FIGS. 9 and 10.
Figure 14:
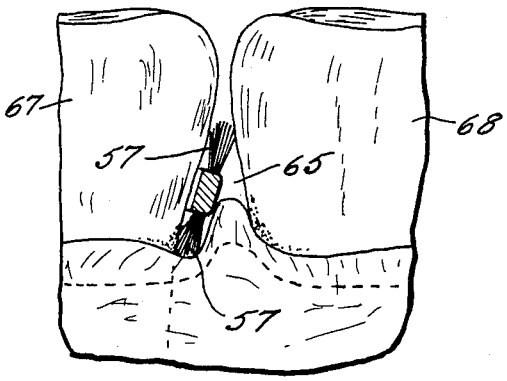
FIG. 14 is a cross-sectional view showing details of the cleaning operation shown in FIG. 13.

Referring to FIGS. 13 and 14, the interproximal areas 65 between adjacent teeth 67, 68 become enlarged during advanced periodontal disease because the diseased gums recede downward. Nevertheless, the interproximal spaces, such as interproximal space 65 remains somewhat confined. Therefore, the small brush 55 according to the present invention should be less than 1 centimeter between the ends of the tufts 57. Therefore, each tuft should be no more than 4 millimenters long in order to accommodate the physical denominations of the brush head 59. In the preferred embodiment, the tufts 57 are approximately two millimeters long, with the total distance between the tips of the tufts being six millimeters. While this may seem slightly large, this enables one row of tufts 57 to assist in forcing an opposed row of tufts 57 into contact with the sulcus. Since the small toothbrush 55 is fairly small, the amount of force other than reciprocating force exerted by the user's hand must be limited. Therefore, a small flat handle 67 is provided, the handle being suitable for grip between the user's thumb and forefinger. This enables the user to aim and angle the small toothbrush 55 into each of the sulcular areas adjacent each tooth, as can be seen in FIG. 14. The handle 67 exhibits a symmetry permitting reversal of the direction of curvature of the toothbrush by the user in a manner such as the handle 25 permits a reversal of the direction of curvature of toothbrush 21.

While the invention has been described in terms of specific brush configurations, it should be clear that various modifications may be undertaken without departing from the inventive concepts expressed herein. For example, it is possible to combine small and large-curved toothbrush heads into a two sided toothbrush. Such an example of such an arrangement is found in U.S. Pat. No. 890,143 to Kuzzer, although a different type of toothbrush head is shown. Accordingly, the invention described herein should be considered limited only as defined by the claims.

It should also be pointed out that, because of the flexible nature of the smaller (interproximal) brush, a straight head rather than a curved head may be provided. This type of straight head would readily conform to the curvature of the interradicular sulci. It may well be that such a straight brush head may be advantageous because the patient would not be required to rotate the brush head in accordance with the direction of curvature.

It is also anticipated that the brushes according to this invention would be provided with a stem adapted to mount on conventional motorized (electric) toothbrush handles. This would permit the patient to take advantage of the efficiency of a motorized toothbrush.

Similarly, the brush head 27, 59 may themselves be made removable from their respective handles 25, 67. This permits the heads to be changed between brushings, giving the heads a chance to more thoroughly dry and therefore reducing sepsis.

What is claimed is:

1. A toothbrush comprising a longitudinal stem having a handle portion and a bristle-supporting portion, the bristle-supporting portion (a) defining a forward part of the stem along the longitudinal length of the stem;

(b) having two oppositely-disposed faces which are generally parallel to the plane of the bristle-supporting portion and from which the bristles extend; and (c) being curved along its length to provide improved access to the gingival areas of the teeth for penetration into the sulcular area to provide the user with a means to apply the curved portion of the toothbrush to opposite sides of the teeth located in all areas of the mouth, the teeth defining a curved dental profile; the bristles being grouped in tufts, the tufts being arranged in a plurality of rows along the longitudinal length of the bristle-supporting portion and at least a portion of the tufts being canted from each of the faces towards the inside of the curve of the bristle-supporting portion.

2. The toothbrush of claim 1, wherein each tuft comprises a plurality of individual bristles extending through the bristle-supporting portion and both of the opposite sides of the bristle-supporting portion.

3. The toothbrush of claim 1 further characterized in that substantially all of the bristles cant toward the inside of curve in said manner.

4. The toothbrush of claim 3 further characterized in that the handle portion is contoured to facilitate improved control of said toothbrush by providing a symmetrical twist in said contour to accomodate the user's thumb and the user's fingers at a desired angle with respect to the bristle-supporting portion.

5. The toothbrush of claim 1 further characterized in that one row of said rows cant toward the inside of the curve in said manner and at least one row extends substantially perpendicular to said faces.

6. The toothbrush of claim 5 further characterized in that the handle portion is contoured to facilitate improved control of said toothbrush by providing a symmetrical twist in said contour to accomodate the user's thumb and the user's fingers at a desired angle with respect to the bristle-supporting portion.

7. The toothbrush of claim 6 further characterized in that the handle portion comprises a flattened area to facilitate grip between the user's thumb and finger while orienting the bristle-supporting portion toward the gingival sulcus.

8. The toothbrush of claim 1 further characterized in that said bristles are integrally molded into the bristle-supporting portion and in that the length of said bristles, as they extend from either of said faces, are no more than three millimeters long.

9. A toothbrush wherein a plurality of tufts of bristles extend from opposite sides of a bristle-supporting portion characterized in that:

(a) a longitudinal stem comprises a handle portion and said bristle-supporting portion, said bristle-supporting portion defining a forward part of the stem along the longitudinal length of the stem;

(b) the bristle-supporting portion of the stem has two oppositely-disposed faces from which said bristles extend;

(c) said bristle-supporting portion curves along the length with oppositely-disposed faces generally parallel to the plane of the bristle-supporting portion and from which the bristles extend, wherein said curvature provides an improved access to the gingival areas of the teeth for penetration into the sulcular area; and (d) the bristles extending from two opposite sides of the bristle-supporting portion permit said improved access by providing the user with a means to apply the curved portion of the toothbrush to opposite sides of the teeth located in all areas of the mouth, the teeth defining a curved dental profile, wherein said handle portion is twisted with respect to said bristle-supporting portion, each of the surfaces of the bristle-supporting portion having a step thereon, the bristles being grouped in tufts which extend perpendicularly from said surfaces so that the tufts are canted with respect to the major axis of the bristle-supporting portion.

10. A toothbrush wherein a plurality of tufts of bristles extend from opposite sides of a bristle-supporting portion characterized in that:

(a) a longitudinal stem comprises a handle portion and said bristle-supporting portion, said bristle-supporting portion defining a forward part of the stem along the longitudinal length of the stem;

(b) the bristle-supporting portion of the stem has two oppositely-disposed faces from which said bristles extend;

(c) said bristle-supporting portion curves along the length and has oppositely disposed faces from which the bristles extend, wherein said curvature provides an improved access to the gingival areas of the teeth for penetration into the sulcular area; and (d) the bristles extending from two opposite sides of the bristle-supporting portion permit said improved access by providing the user with a means to apply the curved portion of the toothbrush to opposite sides of the teeth located in all areas of the mouth, the teeth defining a curved dental profile, wherein said handle portion is twisted with respect to said bristle-supporting portion, the oppositely-disposed faces of said bristle-supporting portion forming an angle with each other so that said bristle-supporting portion is wedge shaped, tufts of bristles extending perpendicularly from the surface of said oppositely-disposed faces.

11. The toothbrush of claim 10, wherein said angle is no greater than 30 degrees.

12. The toothbrush of claim 10, wherein said angle is substantially 20–30 degrees.

13. A toothbrush comprising:

a stem defining a handle portion and a bristle-supporting portion, said bristle-supporting portion extending generally in a plane;

said bristle-supporting portion curving along its length in said plane to conform to a curved dental profile and comprising generally oppositely disposed bristle-supporting surfaces;

said toothbrush further comprising bristles extending from each of said oppositely disposed surfaces, at least some of the bristles extending from each of said surfaces being canted inwardly toward the inside of said curve.

14. The toothbrush of claim 13, wherein said oppositely disposed surfaces are substantially parallel to said plane, at least some of said bristles extending from each of said surfaces being canted with respect to said respective surface.

15. The toothbrush of claim 13, wherein each said oppositely-disposed surface is canted with respect to said plane, said bristles extending substantially perpendicularly from each of said surfaces.

16. The toothbrush of claim 13, wherein each said oppositely disposed surface comprises at least one stepped portion, each stepped portion being canted with respect to said plane, at least some of said bristles extending from each said oppositely disposed surface extending substantially perpendicularly to said respective stepped portion.

* * * * *